US006471522B2

(12) United States Patent
Kendall

(10) Patent No.: US 6,471,522 B2
(45) Date of Patent: Oct. 29, 2002

(54) EVACUATED HIGH VOLTAGE CONNECTOR

(75) Inventor: Charles B. Kendall, Brookfield, WI (US)

(73) Assignee: GE Medical Systems Global Technology Company, LLC, Waukesha, WI (US)

( * ) Notice: Subject to any disclaimer, the term of this patent is extended or adjusted under 35 U.S.C. 154(b) by 0 days.

(21) Appl. No.: 09/751,878

(22) Filed: Dec. 28, 2000

(65) Prior Publication Data

US 2002/0086560 A1 Jul. 4, 2002

(51) Int. Cl.[7] ..... H01R 13/60
(52) U.S. Cl. ..... 439/42; 439/89
(58) Field of Search ..... 439/42, 197, 324, 439/272, 89

(56) References Cited

U.S. PATENT DOCUMENTS 4,209,745 A * 6/1980 Hines ..... 324/158 F
4,780,086 A * 10/1988 Jenner et al. ..... 439/42
4,842,526 A * 6/1989 Stukalin et al. ..... 439/42
5,247,424 A * 9/1993 Harris et al. ..... 361/704
5,514,562 A * 5/1996 Saugmann et al. ..... 435/23
5,576,937 A * 11/1996 Kubo ..... 361/820

OTHER PUBLICATIONS

IBM Technical Disclosure Bulletin, vol. 20, No. 118, pp. 4846–4847, Apr. 1978.*

* cited by examiner

*Primary Examiner*—Khiem Nguyen

(57) ABSTRACT

A connector between an x-ray tube and high voltage source. An epoxy-filled housing is connected to the casing or housing of an x-ray tube or vacuum vessel. A high conductivity silicone gasket is positioned between the ceramic insulator of the x-ray tube and the epoxy material in the housing. Air is evacuated in the joint between the connector housing and x-ray tube vessel and a vacuum created therein. Appropriate seals are positioned maintaining the integrity of the vacuum. Spring-loaded attachment bolts are also utilized to secure the connector housing and vacuum vessel casing together.

24 Claims, 2 Drawing Sheets

EVACUATED HIGH VOLTAGE CONNECTOR

TECHNICAL FIELD

The invention relates to high voltage connection mechanisms and more particularly to connection mechanisms between x-ray tubes and high voltage power sources.

BACKGROUND OF THE INVENTION

There are numerous connectors known today between a source of high voltage on the one hand and a system or mechanism in which the high voltage is utilized on the other hand. One of these connector mechanisms connect high voltage sources to x-ray tubes for use in the medical and/or industrial areas. The connections must be reliable and yet removable for maintenance and replacement.

Reliable yet removable high voltage connectors require that the interface between the connector and the high voltage system be free of voids and provide a secure connection. In the areas in which x-ray tubes are utilized, the connectors typically fall into two categories, oil filled and dry. Dry-type connectors typically use tapered wafers of compliant silicone to make a tight connection between the x-ray tube and the high voltage cable. Pressure applied through bolts in the connector-housing compress the silicone members to remove air from the connection. The silicone members have poor thermal connectivity, however, and heat can be trapped in the connection accelerating failure.

In an effort to overcome this problem with dry-type connections, thermally conductive silicones have been utilized. The additives which enhance connectivity, however, reduce the compliance of the silicone layer making it difficult to compress and exude air from the joint.

Thus, a means or mechanism for making a reliable connection between high voltage sources and x-ray systems using higher conductivity silicone members is needed.

SUMMARY OF THE INVENTION

It is an object of the present invention to provide an improved connector mechanism between a source of high voltage and an x-ray tube. It is another object of the present invention to provide a reliable high voltage connector mechanism using higher conductivity silicone material in a dry-type connection.

The present invention overcomes the problems with dry-type connectors and provides a secure and reliable yet removable high voltage connection for a dry-type connector assembly. In accordance with the present invention, an epoxy-filled housing is removably mounted to an x-ray tube ceramic insulator. A high conductivity silicone gasket member with parallel faces is positioned between the ceramic insulator and the epoxy material in the housing. Seals between the connector housing and casing of the x-ray tube form a vacuum seal. The space between the x-ray tube casing and connector housing is evacuated by a vacuum. The vacuum causes the connector housing to be pressed onto the silicone gasket member which in turn is pressed onto the ceramic insulator. This results in a loaded and air-free connection. Spring loaded attachment bolts hold the connector housing to the x-ray tube casing and maintain the security of the joint over the life of the connector.

In an alternate embodiment, a second housing is positioned over the epoxy-filled connector housing and the space between the two housings is filled with a cooled liquid.

DESCRIPTION OF THE PREFERRED EMBODIMENTS(S)

The present invention relates to secure and reliable connection mechanisms particularly between x-ray tubes and high voltage sources. However, the present invention is not be limited only to that situation since it encompasses all connectors and connection mechanisms between high voltage sources on the one hand and a mechanism or device which utilizes the high voltage on the other hand. The term "x-ray tube" is also defined to be sufficiently broad to cover any vacuum vessel in which a high voltage is needed or utilized, and thus the term "vacuum vessel" is used herein to mean x-ray tubes and other vacuum-type high voltage powered devices."

Problems have been experienced today in the use of dry-type connection assemblies between high voltage sources and vacuum vessels, particularly when thermally conductive silicone gaskets are utilized. The additives which are used to enhance conductivity in the silicone material reduce the resiliency or compliance of the material. This makes evacuation of air from the joint or connection more difficult. Any remaining air in the joint or connection can adversely affect the electrical integrity of the connection and thus reduce the life of the connector.

In general, in accordance with the present invention, a filled connector housing is utilized, and the air in the connection joint is evacuated by a vacuum in order to compress the silicone gasket between the filled housing and the ceramic insulator of the vacuum vessel. Appropriate seals and spring-loaded fasteners are utilized to hold the connector and vacuum vessel together. This maintains the integrity of the joint and increases the life of the connector.

Figure 1:
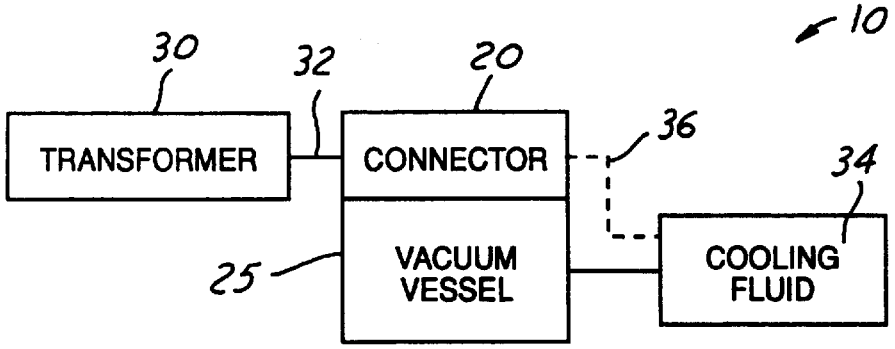
FIG. 1 schematically illustrates a system in which the present invention is utilized.

A system in which the present invention can be utilized is shown schematically in FIG. 1 and referred to generally by the reference numeral 10. In general, the connector mechanism 20 is attached to a vacuum vessel 25 and connects a transformer 30 or other high voltage source via cable 32 to the vacuum vessel 25. Also, in accordance with known technology, the vacuum vessel 25 typically is cooled by a conventional cooling system 34 which includes a cooling fluid, such as oil. Also, with respect to one embodiment of the present invention, as shown and discussed below with respect to FIG. 5 below, the cooling system can also be used to cool the connector 20. This is shown in the alternative by dash line 36 in FIG. 1.

Figure 3:
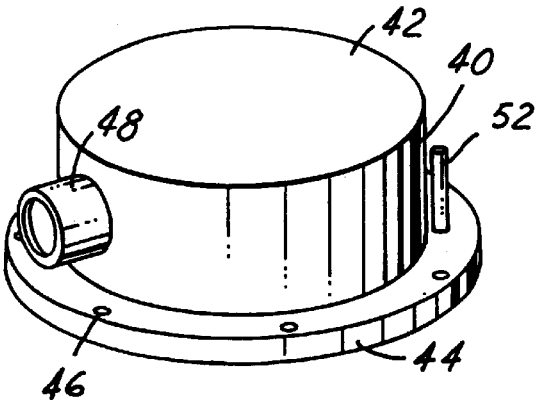
FIGS. 3 and 4 are schematic perspective top and bottom views, respectively, of a preferred connector housing in accordance with the present invention.
Figure 4:
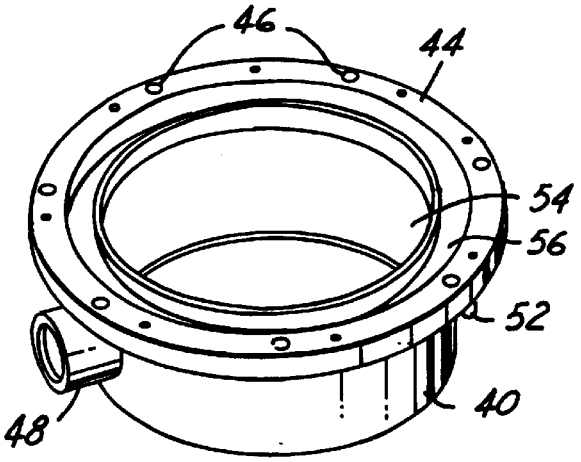

A preferred embodiment of the connector housing 40 is shown in FIGS. 3 and 4, with FIG. 3 being a top perspective view, and FIG. 4 being a bottom perspective view. The housing 40 has a generally cylindrical portion 42 and an annular connection flange 44. The flange 44 has a plurality of openings 46 spaced around its circumference for position of fasteners, as described below. The connector housing 40 also has a port 48 for entry of the high voltage cable 50, as well as an evacuation port 52 which is used during the vacuum procedure. The connector housing 40 has a central cavity 54, as shown in FIG. 4, as well as an annular groove or channel 56.

Figure 2:
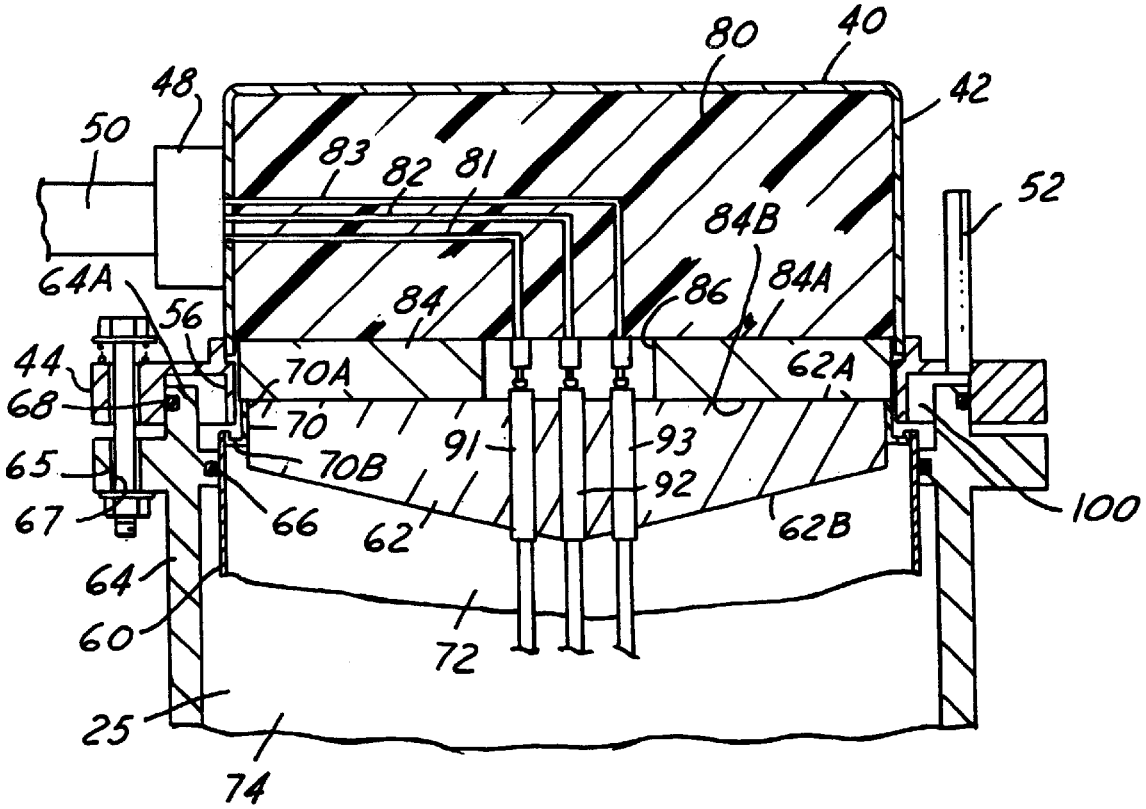
FIG. 2 is a schematic cross-sectional view of a preferred embodiment of the present invention.

As shown schematically in FIG. 2, the connector housing 40 is adapted to be positioned on the end of a vacuum vessel 25 and used to connect the high voltage cable 50 with the vacuum vessel. In this regard, the vacuum vessel 25 has a generally cylindrical container 60 connected to a ceramic insulator 62. The container 60 is positioned inside an outer supporting container 64 which provides a supporting structure for the vacuum vessel. An annular seal 66, such as an O-ring, is used to provide a seal between the inner container 60 and the outer container 64.

As shown in FIG. 2, the connector housing 40 is positioned over the end 64A of the support housing 64. The end 64A is annular and fits within the annular groove 56 in the connector housing. A seal 68, such as an O-ring, is used to provide a seal between the connector housing 40 and the supporting container 64.

The ceramic insulator 62 can be of any conventional type, such as an alumina (aluminum oxide), insulator which is a sintered ceramic material. The insulator 62 has a flat or planar outer surface 62A and a conical or angular inner surface 62B. The insulator 62 is brazed at 70A to annular connector member 70, which in turn is welded at 70B to the upper end of the vacuum vessel container 60. Each of these connections, namely connections 70A and 70B, provide air tight secure connections. In this regard, a vacuum is typically provided in the inner space or volume 72 of the vacuum vessel 25.

The space 74 which exists between the container 60 and outer supporting container 64 is typically filled with a cooling fluid (not shown), such as oil, which is circulated in the space 74 by the cooling system 34.

The interior volume (central cavity) 54 of the connector housing 40 is filled with an electrically insulating material 80, such as an epoxy. Also, potted in the epoxy insulating material 80 are three wires or electrical connectors 81, 82, and 83, which are part of the high voltage cable 50.

Positioned between the insulator 62 and insulating material 80 is a silicone gasket member 84. The gasket member 84 is made from a high thermal conductivity material and has an annular shape with parallel faces 84A and 84B and a central opening 86. The thermally conductive material forming the silicone gasket 84 can be of any conventional type, such as those currently used with conductivity enhancing additives in them.

The ceramic insulator 62 has a plurality of elongated connectors 91, 92, and 93 which are either molded into the insulator when it is made or positioned in holes formed in the insulator after it is made. The shaft connectors are typically made from a Kavor material.

The annular flange member 70 is made of any metal material, such as Kovar™. The cylindrical vacuum vessel 60 is typically made from a metal material, such as stainless steel. The outer support housing container 64 is also typically made of a conductive metal material, such as aluminum. The sealing members 66 and 68 are typically made from an elastomeric material, such as nitryl, buna-N, or rubber. The connector housing 40 also can be made of any conductive metal material, but preferably is made from an aluminum material.

The support housing 64 has an annular flange 65 around its outer surface which mates with flange 44 on the connector housing 40. The flange 65 has a plurality of openings 67 which correspond in number and are aligned with the openings 46 in the housing 40.

Connector members, such as copper contact buttons 94, are positioned on the ends of the shaft contacts 91, 92, and 93 on the surface 62A of the ceramic insulator 62. The contact buttons are positioned in the space formed by the central opening 86 in the silicone gasket member 84. In this regard, when the connector housing 40 is assembled onto the vacuum vessel 25, the wire connectors 81, 82, and 83 are soldered or otherwise connected to the copper buttons 94 which, in turn, supply high voltage electricity into the vacuum vessel through the connectors 91, 92, and 93.

A plurality of fastener members 98, preferably spring-loaded bolts or the like are positioned through aligned openings 46 and 67 and used to hold the connector housings 40 to the vacuum vessel 25. The spring loaded fastener members apply a force between the two annular flanges 44 and 67 in order to securely and firmly hold the connector housing and vacuum vessel together.

During assembly, the connector housing 40 is lightly positioned over the ceramic insulator 62 such that the flange 44 slightly engages the O-ring 68 on the support housing 64. A vacuum is then applied through evacuation port 52 which draws out the air in space 100. As the pressure in the connector 20 drops, the connector housing 40 is pressed onto the silicone gasket 84 which, in turn, is pressed against the ceramic insulator 62. Once the desired level of vacuum has been achieved, the attachment bolts and preloaded springs are installed. The joint between the flanges 44 and 67 is also sealed in any conventional manner. The springs in the attachment fasteners apply additional preload to the joint to maintain joint security in the event that the vacuum in space 100 reduces over the life of the connector.

Once the appropriate vacuum level is reached in the annular space 100, the evacuation port is closed or crimped off in a conventional manner, preventing the vacuum from dissipating.

The net effect of the present invention is that no additional force is applied on the ceramic insulator 62. This is significant since ceramic insulators are relatively delicate and fragile and can crack if too much pressure is applied to them. The ambient air pressure slightly compresses the gasket member while removing the air surrounding it resulting in a loaded and air free connection.

The force on the housing 40 is basically one atmosphere due to the atmospheric pressure. The vacuum in the space 100 allows use of the atmospheric pressure to preload the connector without putting additional load on the ceramic insulator. Thus, the invention results in a net effect of one atmosphere force on the vacuum vessel without any additional force on the ceramic insulator. This results in approximately 500 pounds of preload force in the connector 20. The spring-loaded fasteners 98 supply approximately another 500 pounds of preload creating a total of about 1,000 pounds of preload on the connection joint.

Figure 5:
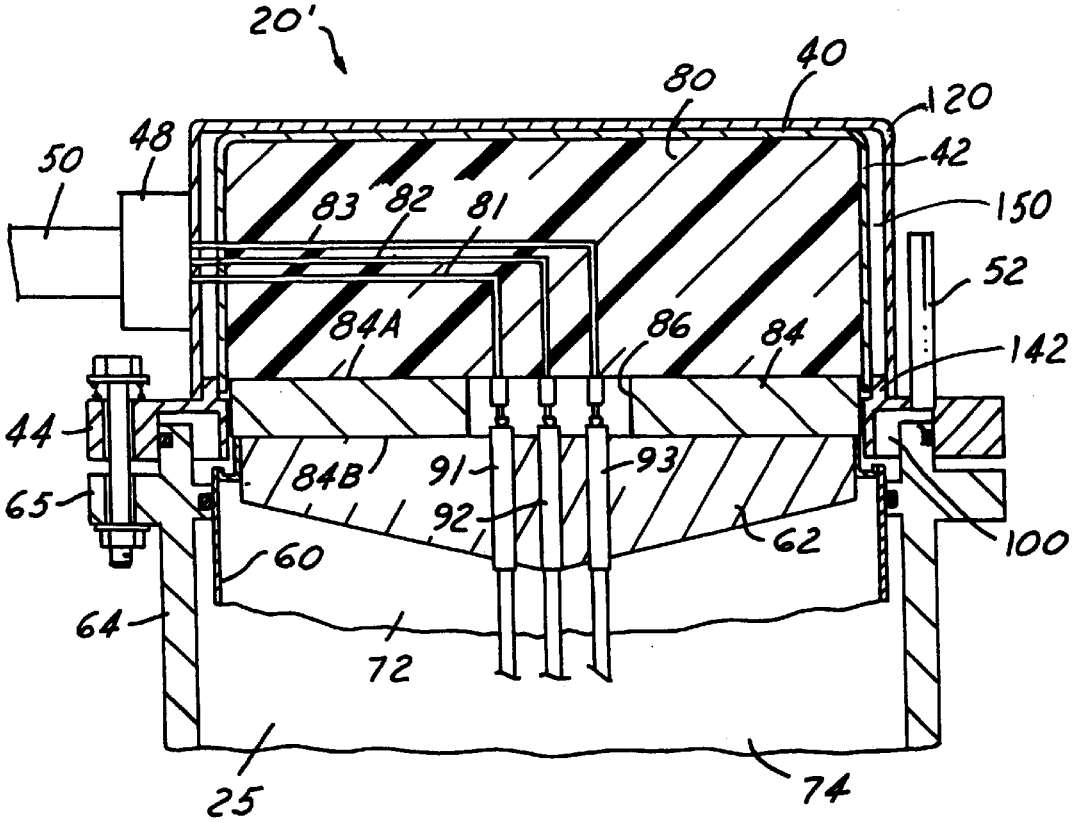
FIG. 5 is a cross-sectional schematic view of an alternate preferred embodiment of the present invention.

An alternate connector embodiment 20' of the present invention is shown in FIG. 5. In this embodiment, basically all of the components are substantially the same as those described above, with the exception of an additional housing member 120 being positioned over the connector housing 40. For this purpose, an annular ridge 142 is provided on the connector housing 40 in order to separate and support the housings 40 and 120. Preferably, the outer housing is also made from a metal material, such as aluminum.

The annular space or volume 150, which exists between the two housing members 40 and 120 is filled with a cooling fluid, such as transformer oil. The cooling fluid is circulated by a cooling mechanism or system, such as cooling system 34 shown in FIG. 1, in order to dissipate heat from the connector 20'.

While the invention has been described in connection with one or more embodiments, it is to be understood that the specific mechanisms and techniques which have been described are merely illustrative of the principles of the invention. Numerous modifications may be made to the methods and apparatus described without departing from the spirit and scope of the invention as defined by the appended claims.

What is claimed is:

1. A method of securely attaching a high voltage connector device to a vacuum vessel, said method comprising the steps of:

assembling said connector device on said vacuum vessel, said vacuum vessel having a vessel container and insulator member and said connector device having a first connector housing filled with an insulating material;

positioning a substantially flat gasket member between said first connector housing and said insulating material, said gasket member being made from a silicone material;

said insulator member having a first substantially planar surface and said insulating material having a second substantially planar surface;

positioning a second connector housing over said first connector housing leaving an annular space between them;

cooling the annular space between said first and second housing members with a cooling fluid;

pulling a vacuum and thereby removing the air in the space between said connector device and said insulator member, thereby compressing said gasket member between said first and second substantially planar surface; and securing said connector device to said vacuum vessel.

2. The method as recited in claim 1 wherein the connector device is secured to said vacuum vessel by a plurality of fasteners.

3. The method as recited in claim 2 wherein said fasteners are spring-loaded bolt members.

4. The method as recited in claim 1 wherein said insulator member is made from a ceramic material and said insulating material is an epoxy material.

5. The method as recited in claim 1 further comprising a vacuum evacuation port member on said connector housing.

6. A high voltage connector for connecting a high voltage source to a vacuum vessel, the vacuum vessel having an insulator member, said connector comprising:

a first housing member having a central cavity;

an insulating member positioned in said central cavity;

a substantially flat silicone gasket member positioned adjacent said insulating member;

a second housing member positioned over said first housing member leaving an annular space therebetween;

wherein when said connector is connected to said vacuum vessel, the gasket member is compressed between said insulating member and said insulator member; and wherein said annular space between said first and second housing members can be cooled by circulation of a cooling fluid.

7. The connector as recited in claim 6 wherein said insulator member is made from a ceramic material and said insulting member is made from an epoxy material.

8. The connection as recited in claim 6 wherein the insulator member has a first substantially planar surface, said insulating member has a second substantially planar surface, and said gasket member is compressed between said first and second planar surfaces.

9. The connector as recited in claim 6 further comprising fastener members on said housing member for connecting said connector to the vacuum vessel.

10. A high voltage connector for connecting a high voltage source to a vacuum vessel, said connector comprising a first housing member having a central cavity, insulating material positioned in said central cavity, said insulating material having a substantially planar surface, a gasket member, said gasket member being made from a silicone material and having at least one substantially planar surface positioned in direct contact with said insulating material's substantially planar surface; a second housing member positioned over said first housing member and leaving a cavity therebetween, and means for cooling said cavity between said second housing member and said first housing member, wherein when said connector is connected to the vacuum vessel, the gasket member is compressed creating a tight seal.

11. The connector as recited in claim 10 wherein said insulating material is an epoxy material.

12. The connector as recited in claim 10 further comprising fastening members on said housing member for tightly securing said connector to a vacuum vessel.

13. The connector as recited in claim 10 further comprising a vacuum evacuation port member on said first housing member.

14. A method of securely attaching a high voltage connector device to a vacuum vessel, said method comprising the steps of:

assembling said connector device on said vacuum vessel, said vacuum vessel having a vessel container and insulator member and said connector device having a first connector housing member filled with an insulating material;

positioning a highly conductive gasket member between said first connector housing member and said insulating material;

positioning a second connector housing member over said first connector housing member leaving an annular cavity therebetween;

cooling said annular cavity with cooling means;

pulling a vacuum and thereby removing the air in the space between said connector device and said insulator member; and securing said connector device to said vacuum vessel.

15. The method as recited in claim 14 wherein the connector device is secured to said vacuum vessel by a plurality of fasteners.

16. The method as recited in claim 15 wherein said fasteners are spring-loaded bolt members.

17. The method as recited in claim 14 wherein said insulating material is an epoxy material and is positioned to compress said gasket member against said insulator member.

18. The method as recited in claim 17 wherein said insulating material has a first substantially planar surface, said insulator member has a second substantially planar surface facing said first planar surface, and said gasket member is compressed between said first and second substantially planar surfaces.

19. The method as recited in claim 14 wherein said highly conductive gasket member is made of a silicone material.

20. The method as recited in claim 14 wherein said insulator member is made from a ceramic material and said insulating material is an epoxy material.

21. The method as recited in claim 14 further comprising a vacuum evacuation port member on said first connector housing member.

22. A high voltage connector for connecting a high voltage source to a vacuum vessel, said connector comprising:

a first housing member having a central cavity and an annular flange, said first housing member filled with an insulating material;

a high conductivity silicone gasket member, said gasket member having a central cavity for allowing connection of a high voltage source to a vacuum vessel; and a second housing member positioned over said first housing member and leaving an annular space therebetween for circulation of a cooling fluid thereon.

23. The high voltage connector as recited in claim 22 wherein said silicone gasket member has substantially planar parallel faces thereon.

24. The high voltage connector as recited in claim 22 wherein said insulating material is an epoxy material and is positioned to compress said gasket member wherein said connector is connected to a vacuum vessel.

* * * * *